United States Patent [19]

Rodrigues et al.

[11] Patent Number: 4,877,088

[45] Date of Patent: Oct. 31, 1989

[54] PROCESS AND EQUIPMENT FOR OIL WELL DRILLING AND COMPLETING OPERATIONS IN DEEP WATER

[75] Inventors: Renato S. Rodrigues, Niterói; Jayme H. Ogura, Macaé, both of Brazil

[73] Assignee: Petroleo Brasileiro S.A. - Petrobras, Rio de Janeiro, Brazil

[21] Appl. No.: 143,535

[22] Filed: Jan. 13, 1988

[30] Foreign Application Priority Data

Jan. 13, 1987 [BR] Brazil ..... 8700104

[51] Int. Cl.[4] ..... E21B 7/128; E21B 41/04

[52] U.S. Cl. ..... 166/342; 166/349; 166/351; 166/365; 175/7

[58] Field of Search ..... 166/338–342, 166/344, 349, 351, 360, 365, 368, 85; 405/195, 224; 175/5, 7

[56] References Cited

U.S. PATENT DOCUMENTS

| | | | |
|---|---|---|---|
| 3,321,015 | 5/1967 | Word, Jr. | 166/365 X |
| 3,513,909 | 5/1970 | Peterman et al. | 166/340 X |
| 3,601,188 | 8/1971 | McGlamery et al. | 166/351 |
| 3,788,396 | 1/1974 | Shatto, Jr. et al. | 166/341 |
| 3,945,213 | 3/1976 | Forbes et al. | 166/351 X |
| 3,971,171 | 7/1976 | Wood | 166/351 X |
| 4,611,661 | 9/1986 | Hed et al. | 166/365 X |
| 4,625,806 | 12/1986 | Silcox | 166/339 X |
| 4,671,702 | 6/1987 | Langner | 166/342 |

*Primary Examiner*—Bruce M. Kisliuk

*Attorney, Agent, or Firm*—Sughrue, Mion, Zinn, Macpeak & Seas

[57] ABSTRACT

A process for oil well drilling and completing operations in deep water which allows an oil well drilled in deep water to start producing, the operations being conducted from a dynamically placed vessel, comprising: providing a permanent guide base (9) on the sea bottom containing a high pressure housing (13) having an upper free end (15) adapted to receive safety, drilling, and production (completion) equipment, the upper free end of the high pressure housing being covered by a protective cover (17) having an external conical part (18), the permanent guide base (9) also having attached thereto, by means of a releasing device, a releasable guide-funnel (10) which covers and protects the upper free end of the high pressure housing during drilling of the well but which prevents the production equipment from being installed because of its size and shape; withdrawing the releasable guide-funnel, after drilling operations are finished, by means of a remote control vehicle which activates the releasing device, thus leaving the protective cover exposed which, because of its conical part, is capable of performing the same guiding work as the guide-funnel after the guide-funnel has been removed; and lowering a production (completion) base (20) onto the permanent guide base (9) whereby the protective cover protects the upper free end of the high pressure housing from damage during the lowering step. Equipment for performing the above process is also disclosed.

3 Claims, 4 Drawing Sheets

PROCESS AND EQUIPMENT FOR OIL WELL DRILLING AND COMPLETING OPERATIONS IN DEEP WATER

FIELD OF THE INVENTION

This invention relates to a well-head drilling system for deep water (done with floating drills) so as to enable such wells to be worked for oil, in that it provides a novel interface for completing equipment.

BACKGROUND OF THE INVENTION

In recent years the search for oil and gas fields has spread to waters ever deeper offshore of the mainland. As the depth of water becomes greater, drilling has been done more frequently with the aid of floating drills instead of from fixed platforms, for reasons of cost. Particularly, drills that can be dynamically placed have been used, thus avoiding trouble with anchoring systems.

Drilling in deep water brings up a host of difficulties which has served to highlight the inefficiency of the equipment usually employed in such deep water operations. However, the system of bases that make up the well-head now used in deep water drilling is quite different from that used for shallow water drilling, having been adapted so as to make operation with dynamically placed drills easier since they do not need guiding cables.

Another point which makes drilling difficult in deep water is the question of the degree of tilt of the base, which tilt will bring about a like tilt in the high pressure housing. Since a high pressure housing is used as the support for the blow-out control equipment, the tilt may make the blow-out control operate under stress and thereby lead to premature and undesirable wear of its parts. Therefore control over the tilt of the base system must be exercised. In deep water, such control can be accomplished by means of television cameras, since divers cannot be employed, and in order to carry out such monitoring, visibility must be good so that corrections and other adjustments may be made at the surface by remote control. Such cameras can be installed in the column around which the bases are fixed, as in remote control vehicles. This question of visibility has been taken into account since in the previous base systems gravel would gather at points where visibility had to be best, since the bases are low and return flow would take place through the mouth of the funnel. Therefore, guide-funnels were increased considerably in size and return was made sideways to prevent level gauges from becoming covered over with gravel. Thus, by altering the size of the funnel-guides as well as by altering the base system, it became possible to better place other equipment during installation.

However, improvements in the previous state of the art had not overcome problems in connection with working the wells regarding the next stage of preparation of wells for such purpose.

Among the principal difficulties of previous methods was that of the guide-funnel mentioned above. Because of its greater size (although this made it easier to install the blow-out control equipment), it was difficult to put in wet Christmas trees (which is an art-recognized expression for production well valve control systems). The guide-funnel therefore had to be withdrawn in order to install a wet Christmas tree. On the other hand, without a guide-funnel other difficulties in the deep-water placing of equipment arise, particularly regarding coupling tolerances, especially of the parts that make up the wet Christmas tree.

SUMMARY OF THE INVENTION

One of the purposes of this invention is to provide a system to enable thoroughly safe installation to take place of deep well production equipment without the aforementioned difficulties, for the precise locating of fitting points of the equipment to be assembled (production equipment) upon the equipment already in place (high pressure housing).

Another purpose of the present invention is to provide a process to be used in seating a completion (production) base upon the high pressure housing and to do this so that the parts that fit together do so thoroughly safely, and which also provides for protection of the free end of the high pressure housing and for removal of the guide-funnel from the permanent base guide.

In accordance with this invention, when drilling of the well with a dynamically placed drill is finished, the high pressure housing is protected by a cover which also functions to guide completing equipment to be installed in the well-head after the permanent base guide-funnel has been removed or withdrawn with the aid of remote control vehicles. Withdrawal of the aforesaid guide-funnel leaves free space in which to couple the completion base which, since it lies upon the high pressure housing, makes it easier to tie in the tolerances concerned, to fit in the production well valve control system (i.e., the wet Christmas tree). Since the completion base has posts, this will enable use to be made of the guide cables from the anchored drill rigs, thereby making further operations easier to carry out, for which operations the methods employed are already known and have been used in practice.

The above objects and advantages of the present invention can be accomplished by a process for oil well drilling and completing operations in deep water which allows an oil well drilled in deep water to start producing, said operations being conducted from a dynamically placed vessel, comprising:

(a) providing a permanent guide base (9) on the sea bottom containing a high pressure housing (13) having an upper free end (15) adapted to receive safety, drilling, and production (completion) equipment, the upper free end of the high pressure housing being covered by a protective cover (17) having an external conical part (18), said permanent guide base (9) also having attached thereto, by means of a releasing device, a releasable guide-funnel (10) which covers and protects the upper free end of the high pressure housing during drilling of the well but which prevents said production equipment from being installed because of its size and shape;

(b) withdrawing said releasable guide-funnel, after drilling operations are finished, by means of a remote control vehicle which activates said releasing device, thus leaving said protective cover exposed which, because of said conical part, is capable of performing the same guiding work as said guide-funnel after said guide-funnel has been removed; and (c) lowering a production (completion) base (20) onto said permanent guide base (9) whereby said protective cover protects the upper free end of the high pressure housing from damage during said lowering step.

Equipment for performing the above process is also disclosed, including the permanent guide base having high pressure housing, a protective cover thereover, and a releasable guide-funnel. The guide-funnel is released through a releasing device activatable by remote control.

Brief Description of the Drawings

FIG. 1 is a part section vertical view of the base system with the protecting cover on.

DESCRIPTION OF THE PREFERRED EMBODIMENT

Figure 1:
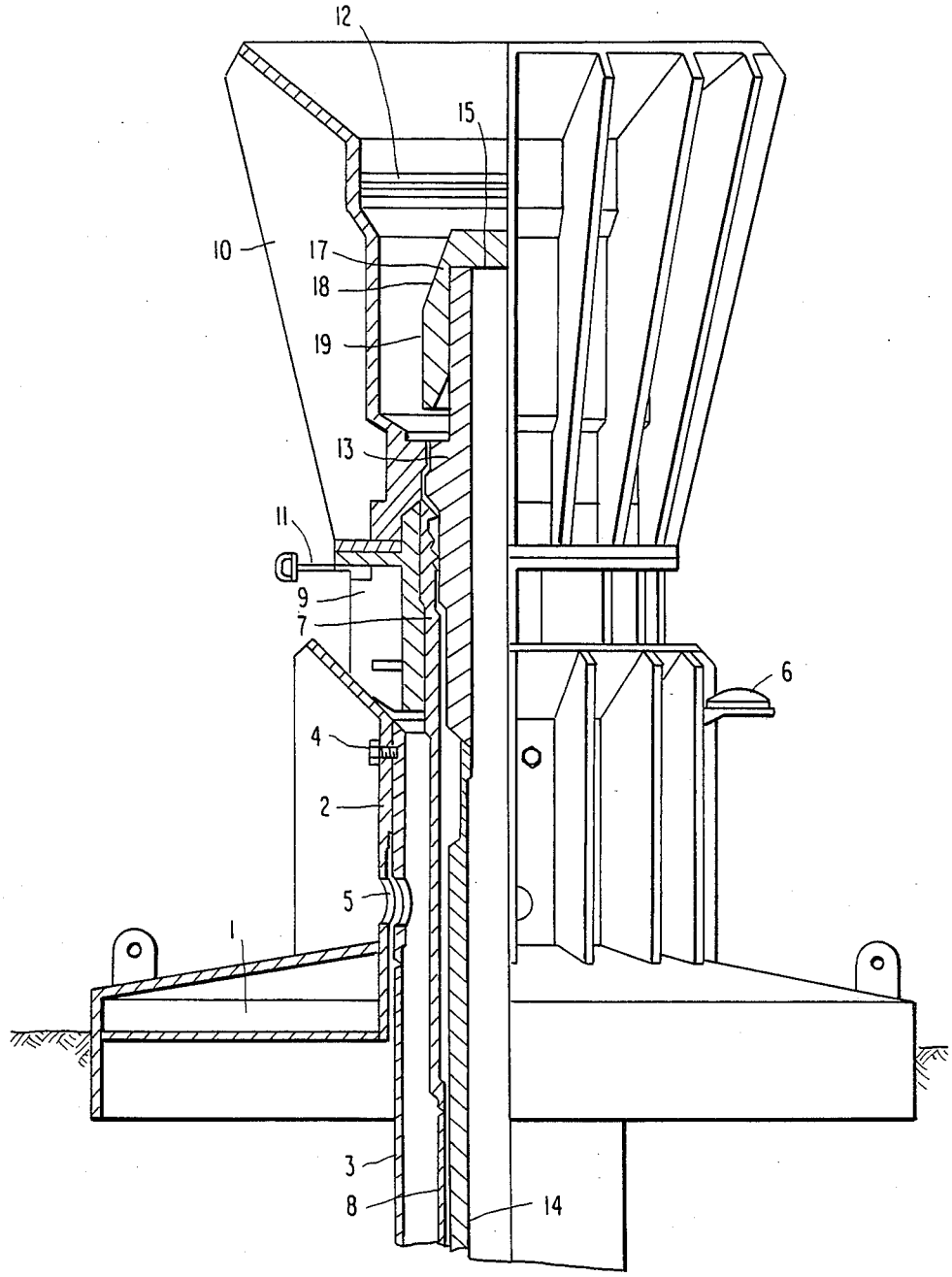

FIG. 1 shows a temporary base 1, lying upon the sea bottom. To further strengthen the well-head assembly, a pipe pile, 3, is driven into the sea bottom by blasting, the pipe pile being in turn attached to the temporary guide base, 1, by means of housing, 2, bolted by bolts, 4, to base 1, indirectly, through the pipe pile, 3. The entire operation is remotely accomplished with the aid of closed-circuit television, the tilt of the assembly in particularly being watched by consulting level gauge, 6, which, since it lies above outlet hole, 5, and the returning gravel, stands clear of any solid particles that might gather thereon.

In keeping with usual practice followed in deep water drlling work, the first stage of well preparation is the drilling thereof, when the casing, 8, fixed to the permanent guide base, 9, by means of low pressure housing, 7, is lowered. The casing, 8, is welded to the aforesaid low pressure housing, 7, and then cemented throughout its whole length.

Usually this is followed by the second stage of well drilling, and when this is finished, the high pressure housing, 13, is lowered onto the permanent guide base, along with its respective casing, 14. Once more, cementing of the casing takes place and a firm base is secured to support the casings to be put into the well, and anchored inside the aforesaid high pressure housing, 13.

As in common knowledge among those skilled in the art, the high pressure housing, 13, has at its top, 15, a shape and seating (ledges, slots, and groove for sealing ring to fit in) suitable for connecting and sealing, respectively, the safety and drilling equipment (blow-out controller) and the production equipment (in the present instance, the wet Christmas tree) and later connection between the well and the surface.

Therefore, the upper free end, 15, of this high pressure housing must be protected, and it must not be banged or damaged in any way. When the well is being drilled, the guide-funnel, 10, releasably attached to the permanent guide base 9 (FIG. 1), is present to provide such protection, by guiding the connector of the blow-out control equipment. However, the guide-funnel prevents the wet Christmas tree from being installed, because of its size and also its shape. Therefore, in order to complete the well, the guidefunnel, 10, must be withdrawn or removed, which leaves the upper free end, 15, of the high pressure housing, 13, completely unprotected and vulnerable to damage at the areas mentioned above.

To overcome this problem, this invention provides a strong protective cover, 17, which not only protects the upper free end, 15, of the high pressure housing but, since it has an external conical shaped section, 18, enables well-head equipment to be fitted in easily, thus replacing guide-funnel, 10, in its channelling or guiding function.

Figure 4:
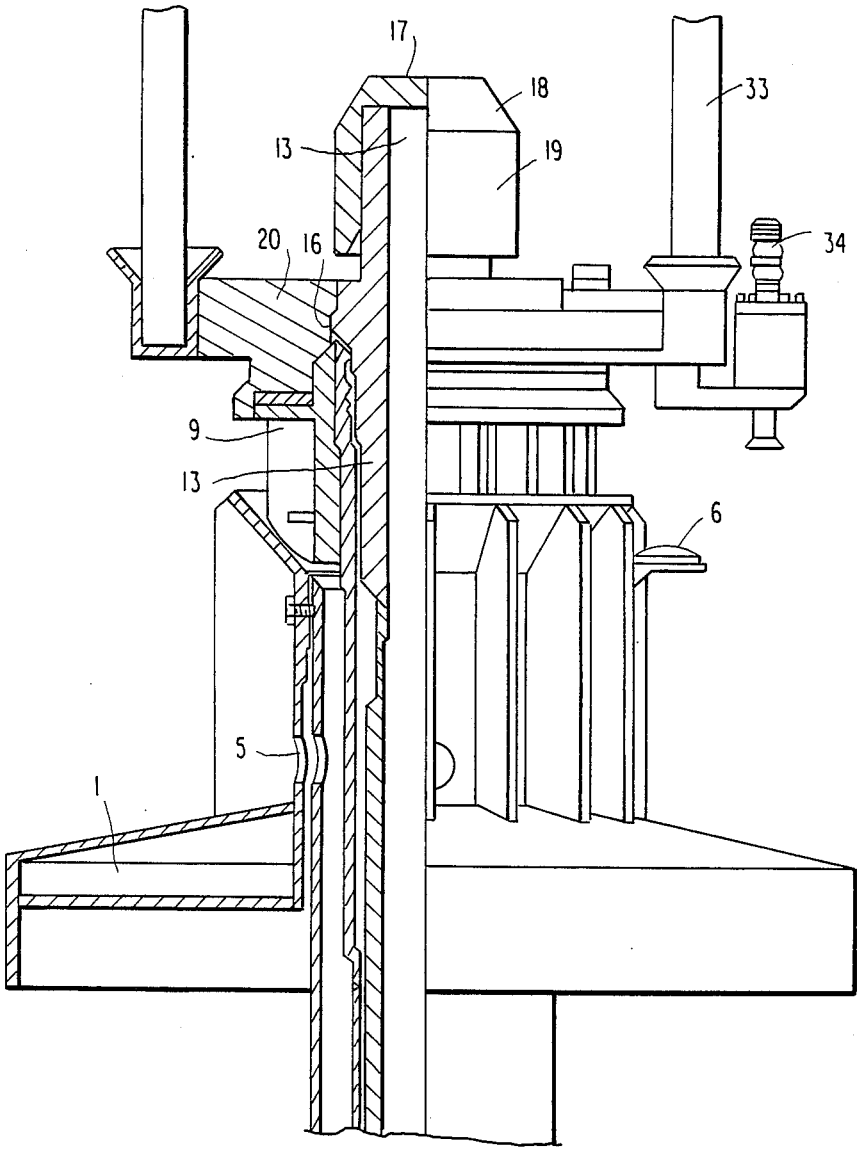
FIG. 4 is a part section vertical side view of the base system being laid upon the production base.

Basically, such protecting cover, 17, consists of a hollow part which at its lower end is cylindrical in shape, 19, and welded at its top end to a top cut-off cone-shaped part, 18, ending up at its top as a circular level part which may be either entirely closed or provided with a hole (though this is not essential for operation of the device, having been subjected to such alterations merely to make installation and removal easier). Essentially, the protective cover, 17, covers the upper free end of the high pressure housing, 13, thereby preventing the latter from being banged by other moving parts or tools during installation of production base, 20, which will be described hereafter (FIG. 4). Likewise, the placing of the cover, 17, upon the high pressure housing, 13, and also the later removal thereof, is effectively done by means of special tools, description of which is beyond the scope of this specification. It should be mentioned that the conical part, 18, of cover, 17, performs the same guiding work as that done by guide-funnel, 10, after the latter has been removed, though their conical features are inverted, that is, opposite to one another.

To carry on with the producing well assembly job once cover, 17, has been installed, guide-funnel, 10, may be withdrawn. To do this, however, there must be some sort of method to disconnect guide-funnel, 10, from its permanent guide base, 9. Such method is depicted in FIG. 1, under number 11, shown in greater detail in FIG. 2, and described below.

Figure 2:
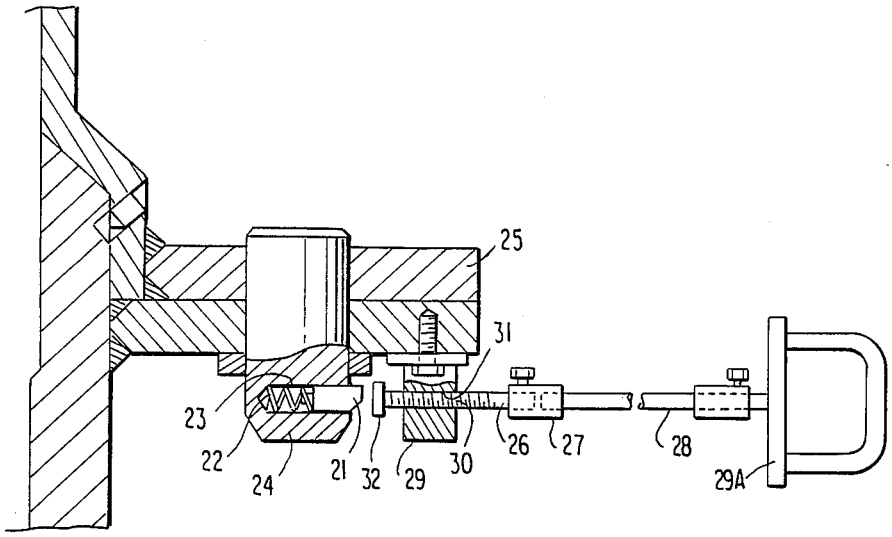
FIG. 2 is a detailed side section view of the guide funnel lock.

As is shown in FIG. 2, there is a pin, 21, kept expanded by a spring, 22, a housed in hole, 23, in the bottom cylindrical part, 24, of guide-funnel, 10, which therefore locks said bottom part, 24, against top plate, 25, of permanent guide base, 9. Upon completion of the well, after cover, 17, has been put on high pressure housing, 13, a remote control vehicle is sent to the well-head to pull out locking pin, 21, by working cotter-pin, 26, which is connected to stem, 28, in such a way that it can be withdrawn, by means of connecting part, 27, which stem, in turn, ends in a grip, 29A, upon which the aforesaid remote control vehicle, not shown, will operate directly.

Figure 3:
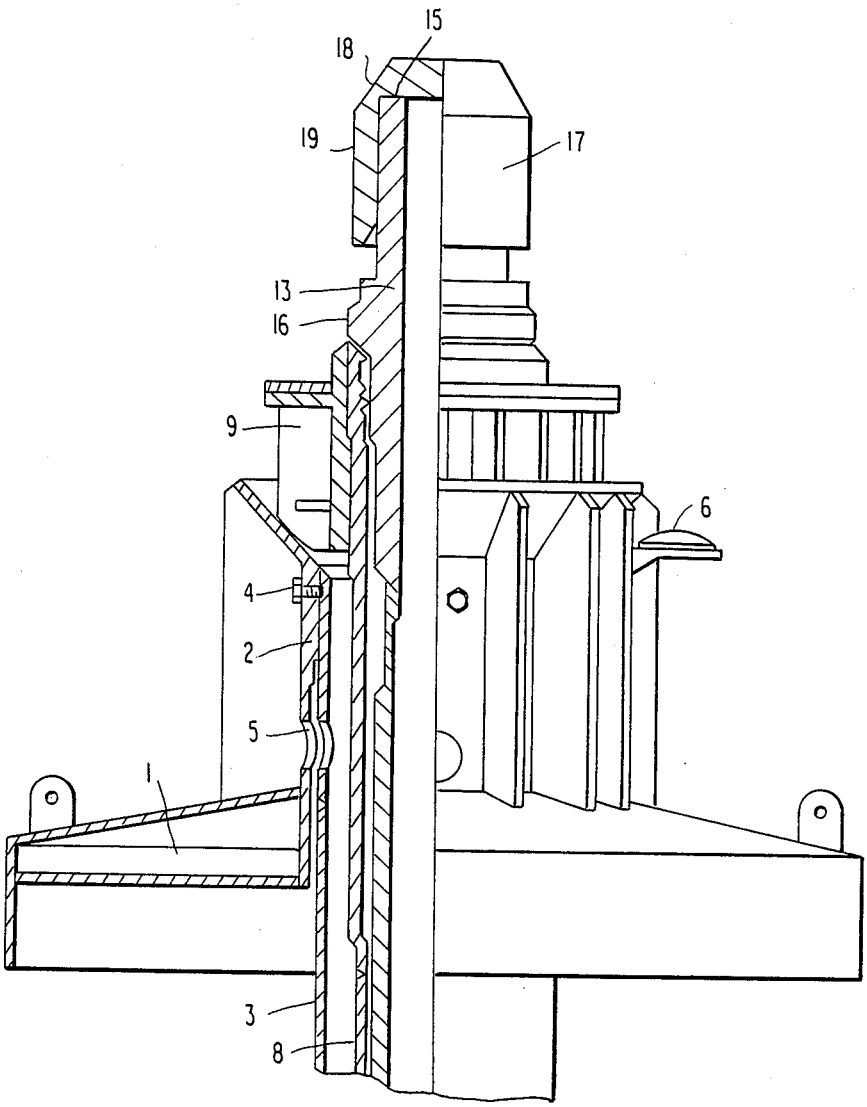
FIG. 3 is a part section vertical side view of the base system able to receive the production base.

As is easy to see from FIG. 2, the top plate, 25, of permanent guide base, 9, has a supporting part, 29, attached to its underside, which part is a block provided with a hole through which the shank of cotter-pin, 26, passes, and the part thereof within the said hole is provided with a male thread, 30, which matches a corresponding female thread, 31, inside the aforesaid hole of the supporting part, 29. When grip, 29A, is worked, the twisting movement exerted upon shank, 28, will be transferred to shank, 26, of the cotter-pin which will cause matched threads, 30 and 31, to turn and thereby bring about sure shifting of aforesaid cotter-pin, 26, in such a way that its flattened end, 32, will press against pin, 21, until such pin is fully held inside hole, 23, with its free end flush with the outside of part, 29, which will enable the lower cylindrical part, 24, of guide-funnel, 10, to move upwards. Next, with pins, 21, held, an extractor tool (not shown) is inserted into the seat of the top of funnel, 10 (FIG. 1, detail, 12), and, by pulling slightly, guide-funnel, 10, can be uncoupled and then removed. As depicted in FIG. 3 (side view) the system is then ready to receive the completion base which will lie directly upon permanent guide base, 9.

As shown in FIG. 4, once guide-funnel, 10, has been withdrawn, the top part of the base assembly has enough space for the completion base, 20 (previously also referred to as the production base) to be easily lowered down. In accordance with this invention the supporting point for the completion or production base, 20, upon the now assembled bases, is the outside ring, 16, of the high pressure housing, 13, which is specially adapted for such purpose. Hence, once the completing base 20, has been firmly lowered upon permanent guide base 9, and guide posts, 33, also having been put in place, and completion base 20 being in a well defined position and connection, 34, for the flow-line being supported thereby, installation of the wet Christmas tree and of the flow-line (which will connect the rig to the surface) will be made easier, while sound tolerance figures are attained for the several dimensions of the coupled parts, without any danger of damage being done to the connecting points. This is entirely possible if the knowledge and the equipment provided in accordance with this invention are used, since now the guide-posts, 33, will enable precise positioning of the various other items of equipment to take place, as, for instance, the wet Christmas tree. It should be noted that before lowering the aforesaid other items of equipment, guided by guide-posts, 33, cover, 17, must be withdrawn with the aid of a remotely controlled tool, which is quite easily done since said cover, 17, is put upon the high pressure housing, 13, just by laying it thereon, no type of fastening being resorted to. As in the case of the drilling operations, these operations for the placing of completing and production items can be done by means of floating anchored drill-rigs.

What is claimed is:

1. A process for oil well drilling and completing operations in deep water which allows an oil well drilled in deep water to start producing, said operations being conducted from a dynamically placed vessel, comprising;

(a) providing a permanent guide base (9) on the sea bottom containing a high pressure housing (13) having an upper free end (15) adapted to receive safety, drilling, and production (completion) equipment, the upper free end of the high pressure housing being covered by a protective cover (17) having an external conical part (18), said permanent guide base (9) also having attached thereto, by means of a releasing device, a releasable guide-funnel (10) which covers and protects the upper free end of the high pressure housing during drilling of the well but which prevents said production equipment from being installed because of its size and shape;

(b) withdrawing said releasable guide-funnel, after drilling operations are finished, by means of a remote control vehicle which activates said releasing device, thus leaving said protective cover exposed which, because of said conical part, is capable of performing the same guiding work as said guide-funnel after said guide-funnel has been removed; and (c) lowering a production (completion) base (20) onto said permanent guide base (9) whereby said protective cover protects the upper free end of the high pressure housing from damage during said lowering step.

2. The process according to claim 1, wherein after withdrawal of the guide-funnel in step (b), the guide-funnel is recovered from the sea by pulling the top of the funnel with a suitable tool.

3. The process according claim 1, further comprising, after step (c), (d) withdrawing said protective cover, using a remotely controlled tool, from the upper end of the high pressure housing; and (e) lowering a wet Christmas tree onto the exposed upper end of the high pressure housing.

* * * * *